US006159063A

United States Patent [19]

Fujii et al.

[11] Patent Number: 6,159,063

[45] Date of Patent: Dec. 12, 2000

[54] OUTBOARD MOTOR

[75] Inventors: Kenichi Fujii; Jiro Saiga, both of Hamamatsu, Japan

[73] Assignee: Suzuki Kabushiki Kaisha, Hamamatsu, Japan

[21] Appl. No.: 09/348,664

[22] Filed: Jul. 6, 1999

[30] Foreign Application Priority Data

Jul. 6, 1998 [JP] Japan ..... 10-190816

[51] Int. Cl.[7] ..... B63H 21/10

[52] U.S. Cl. ..... 440/88; 123/508

[58] Field of Search ..... 440/88, 900; 123/196 R, 123/508

[56] References Cited

U.S. PATENT DOCUMENTS 5,957,112 9/1999 Takahashi et al. ..... 123/469

5,984,743 11/1999 Wada et al. ..... 440/88

6,067,951 5/2000 Kitajima ..... 123/196 R

*Primary Examiner*—Jesus D. Sotelo

*Attorney, Agent, or Firm*—Oblon, Spivak, McClelland, Maier & Neustadt, P.C.

[57] ABSTRACT

An outboard motor has a structure in which a cam shaft is arranged substantially in parallel to a crank shaft disposed in an engine unit so as to perpendicularly extend in an operative state of an outboard motor and a fuel pump is disposed at a portion near an upper end portion of the cam shaft. A swash plate cam is disposed to an upper end of the cam shaft and the fuel pump is provided with a plunger having a projected end portion operatively contacting the swash plate cam to be reciprocally movable in a direction substantially parallel to an axis of the cam shaft when the swash plate cam is driven.

5 Claims, 5 Drawing Sheets

OUTBOARD MOTOR

BACKGROUND OF THE INVENTION

The present invention relates to an outboard motor and, more particularly, to an outboard motor having an improved fuel pump arrangement structure.

In a known art, there has been provided a four-stroke-cycle engine in which a mechanical fuel pump is driven by using an eccentric cam formed on a cam shaft constituting a valve moving mechanism. In such engine, the fuel pump is generally mounted on a cylinder head cover so that a moving (reciprocal) direction of a plunger of the fuel pump is perpendicular to the axis of the cam shaft.

However, in an engine to be mounted to an outboard motor, it is general that a crank shaft is vertically arranged, in an usable state, i.e. in a state of the outboard motor to a hell, and a cylinder head is disposed ar a rear portion of the engine. According to such arrangement, the fuel pump projects rearward, and as a result, the entire longitudinal length of the outboard motor itself will be made longer, providing a problem of compact structure.

SUMMARY OF THE INVENTION

It is therefore an object of the present invention is to substantially eliminate the defects or problems encountered in the prior art and to provide an outboard motor having a compact arrangement structure of a fuel pump.

This and other objects can be achieved according to the present invention by providing, in one aspect, an outboard motor of a structure in which a cam shaft is arranged substantially in parallel to a crank shaft disposed in an engine unit so as to perpendicularly extend in an operative state of an outboard motor and a fuel pump is disposed at a portion near an upper end portion of the cam shaft, wherein a swash plate cam is disposed to the upper end of the cam shaft and the fuel pump is provided with a plunger having a projected end portion operatively contacting the swash plate cam to be reciprocally movable in a direction substantially parallel to an axis of the cam shaft when the swash plate cam is driven.

In this aspect, the swash plate cam has a cam surface having an inclination with respect to a surface perpendicular to the axis of the cam shaft.

In another aspect of the present invention, there is provided an outboard motor comprising:

an engine holder;

an engine unit disposed above the engine holder so as to be held by the engine holder in an operative state of an outboard motor, the engine unit including a cylinder head, a cylinder block and a crank case in which a crank shaft extends perpendicularly;

an engine cover covering the engine unit;

a fuel pump disposed to an upper surface of the engine unit and having a plunger extending downward to be reciprocally movable; and a valve moving mechanism disposed at a rear side portion of the engine unit and including a cam shaft disposed to be substantially parallel to the crank shaft, the cam shaft having an upper surface portion to which a swash plate cam having an inclination with respect to the upper surface portion is formed so as to move the plunger perpendicularly when the swash plate cam is driven.

In the above aspects, the engine cover is formed with an air intake port and at least a portion of the fuel pump is accommodated in the air intake port.

According to the arrangement of the outboard motor provided with the fuel pump arrangement mentioned above, since the plunger of the fuel pump is driven perpendicularly in parallel to the cam shaft extending direction, the fuel pump is not disposed so as to extend rearward of the engine unit, thus making compact the longitudinal size of the outboard motor.

Furthermore, since at least a portion of the fuel pump is accommodated in the air intake port formed to the engine cover, the vertical length of the outboard motor can be made short, thus also making compact of the entire structure of the outboard motor.

The nature and further characteristic features of the present invention will be made clear from the following descriptions made with reference to the accompanying drawings.

DESCRIPTION OF THE PREFERRED EMBODIMENTS

FIGS. 1 to 4 represent one embodiment of the present invention.

Figure 1:
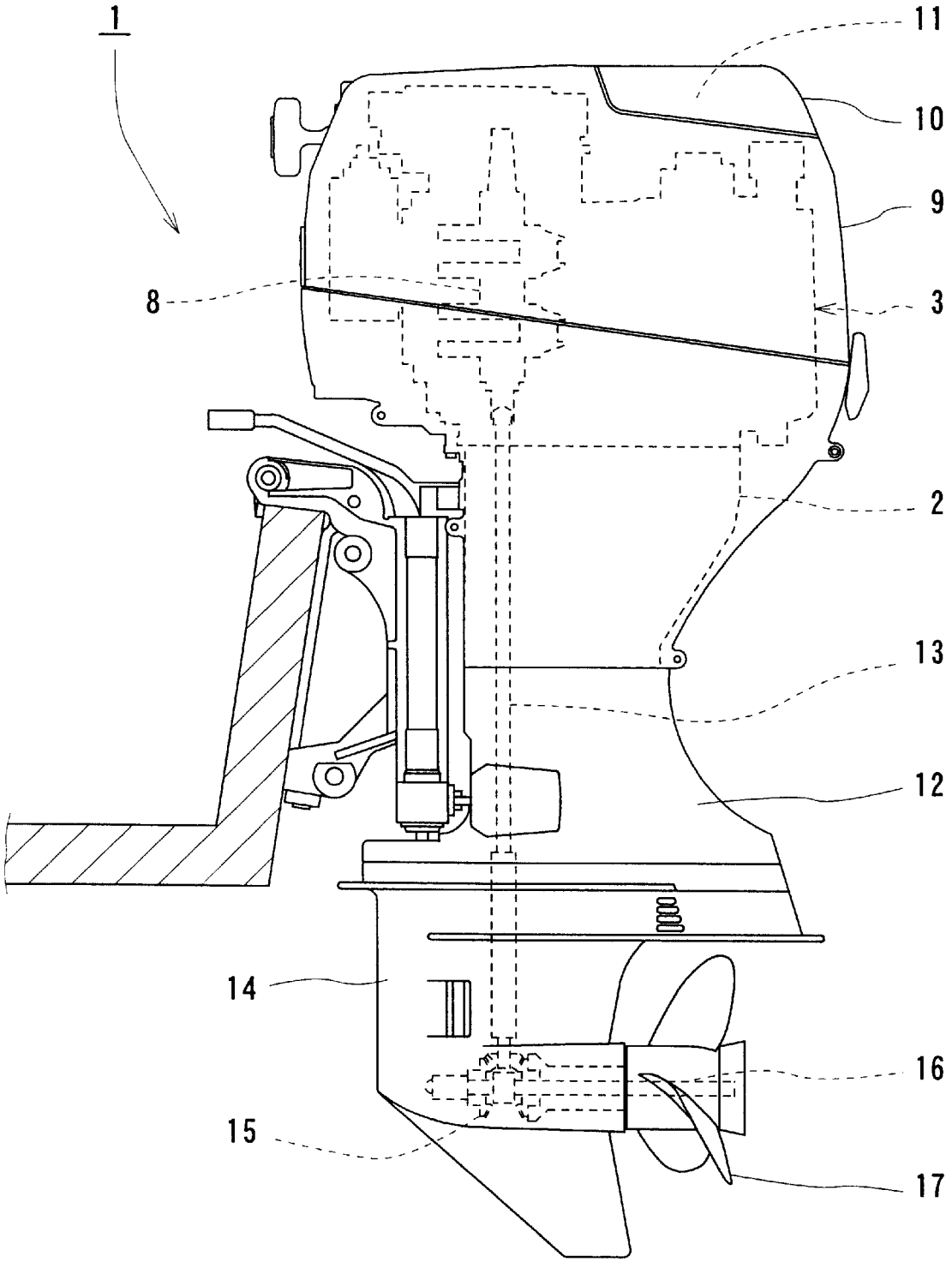
FIG. 1 is a left side view of an outboard motor, in a state mounted to a hull, according to one preferred embodiment of the present invention.
Figure 2:
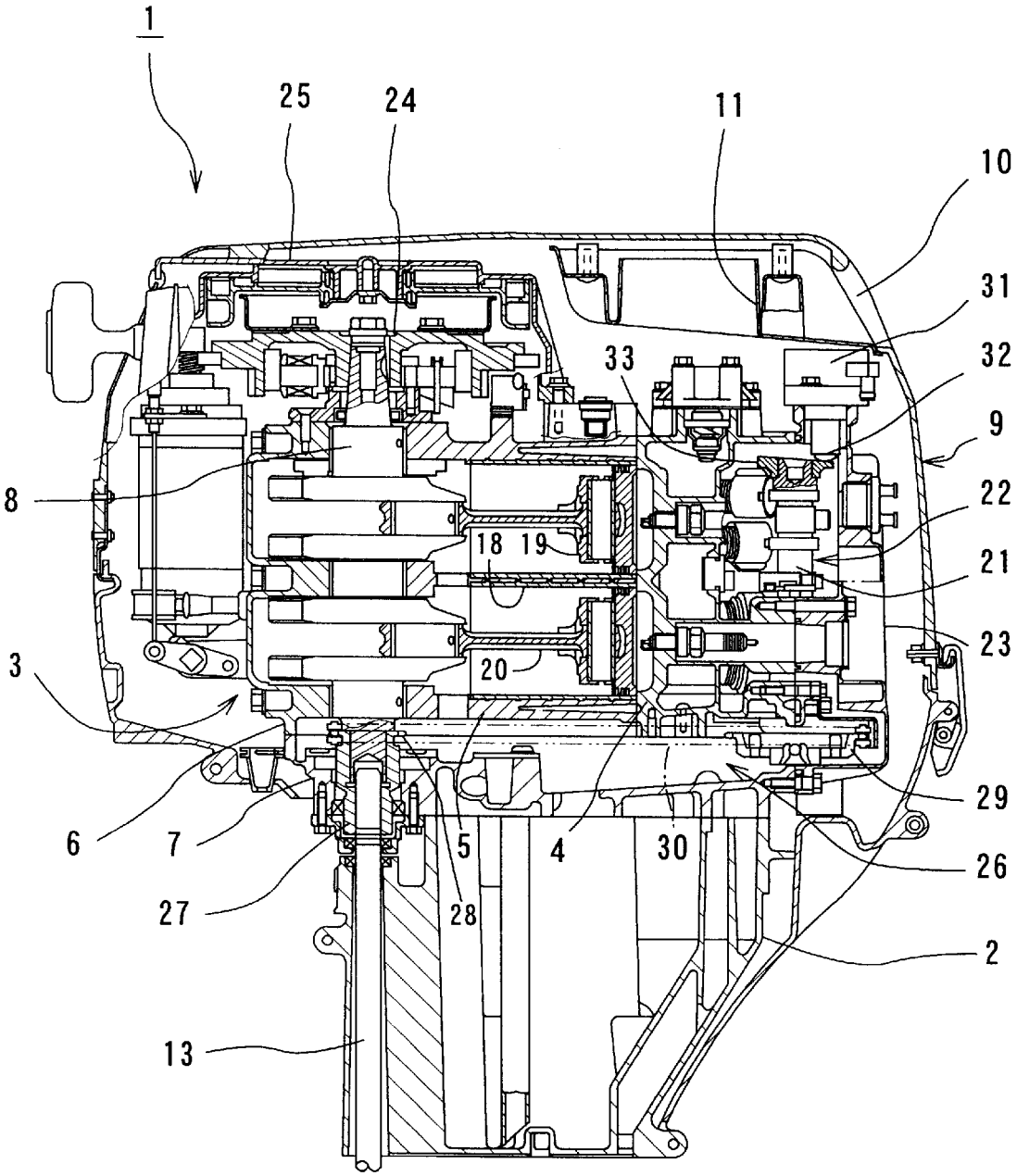
FIG. 2 shows an elevational section of the upper half of the outboard motor shown in FIG. 1.

First, with reference to FIGS. 1 and 2, an outboard motor is mounted to a hull in an operative state and is provided with an oil pan 2 also acting as engine holder and an engine 3 is disposed above the oil pan 2.

The described engine 3 is, for example, a water-cooled four-stroke-cycle two-cylinder engine and is composed of a cylinder head 4, a cylinder block 5, a crank case 6, etc. which are assembled in unit. The engine or engine unit 3 is disposed above the oil pan 2 through a cam chain case 7, which is disposed below the crank case 6, the cylinder block 5 and the cylinder head 4.

The crank case 6 is disposed at the most front side (hull side) of the engine 3 and the cylinder block 5 is disposed to the rear (right side in FIG. 2) portion of the crank case 6. The cylinder head 4 is disposed to the rear side portion of the cylinder block 5. A crank shaft 8 is disposed perpendicularly in a mating portion of the crank case 6 and the cylinder block 5.

The engine 3, the oil pan 2 and surroundings thereof are covered by an engine cover 9, which is formed, at a rear upper portion thereof, with an opening 10 usable as a handle member for opening or closing the engine cover 9. A tubular air-intake port 11 is formed inside the opening 10 so as to extend vertically.

As shown in FIG. 1, a drive shaft housing 12 is disposed below the oil pan 2 and the upper end of a drive shaft 13 is connected to the lower end of the crank shaft 8 so as to extend downward inside the drive shaft housing 12. The lower end of the drive shaft 13 is operatively connected to a bevel gear 15 arranged in a gear case 14 disposed below the drive shaft housing 12. The bevel gear 15 is then connected to a propeller shaft 16 through which a propeller 17 is driven.

With reference to FIG. 2, a cylinder 18 is substantially horizontally arranged in the cylinder block 5 of the engine 3, and a piston 19 is fitted into the cylinder 18 to be axially slidable. The piston 19 and the crank shaft 8 are operatively coupled to each other through a connection rod 20 so as to convert the reciprocal sliding motion of the piston 19 to a rotational motion of the crank shaft 8.

Incidentally, a suction valve and an exhaust valve, not shown, are disposed in the cylinder head 4. A valve moving mechanism 22 for opening or closing these suction and exhaust valves are disposed to a rear portion of the cylinder head 4. The valve moving mechanism 22 is provided with a cam shaft 21 arranged in parallel to the crank shaft 8. The cylinder head 4 is covered by a head cover 23. The upper end of the crank shaft 8 projects upward over the engine 3 and a magneto device 24 and a recoil starter 25 are mounted to the projected end portion of the crank shaft 8.

A cam shaft driving mechanism 26 is disposed in the cam chain case 7 disposed below the engine 3 and the rotational force of the crank shaft 8 is transmitted to the cam shaft 21 thereby to drive the valve moving mechanism 22. The cam shaft driving mechanism 26 is, for example, of a chain-drive-type having a structure comprising a cam drive sprocket 28 mounted to a connection member 27 connecting the crank shaft 8 extending downward from the engine 3 and the drive shaft 13, a cam driven sprocket 29 mounted, to be rotatively integral, to the lower end portion of the cam shaft 21 projecting downward from the engine 3, and a timing chain 30 wound up around the cam drive sprocket 28 and the cam driven sprocket 29.

Figure 3:
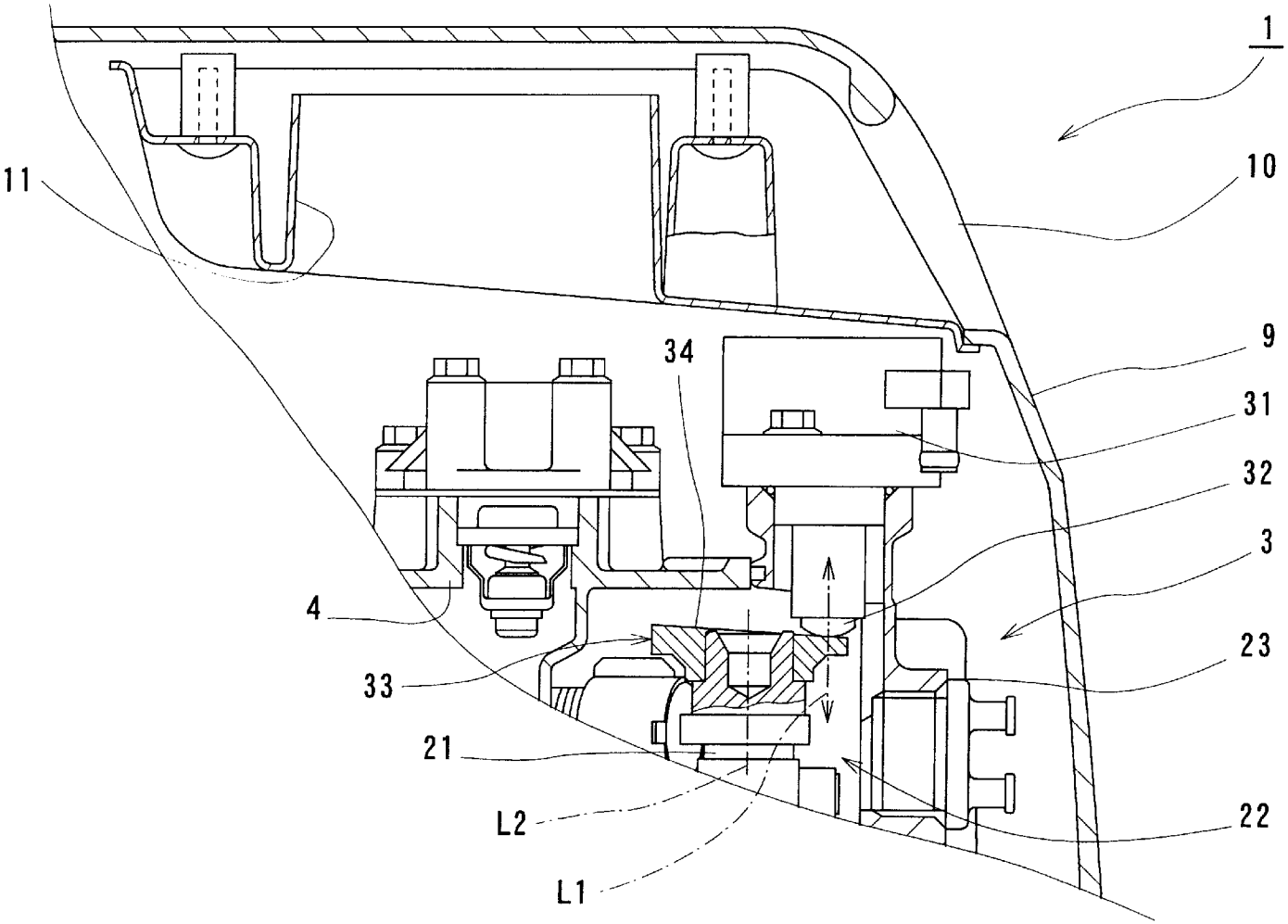
FIG. 3 shows an elevational section of a portion of a rear upper portion of the outboard motor in an enlarged scale.

With reference to FIGS. 2 and 3, the engine 3 of the outboard motor 1 is equipped with a fuel pump 31 of a mechanical type structure. The fuel pump 31 operates to suck up and transfer (deliver) the fuel in accordance with the reciprocal motion of a plunger 32 of the fuel pump 31 projecting downward from the front end thereof. The fuel pump 31 acting as mentioned above is mounted to the upper surface of the engine 3 at a portion near the mating surface portion of the cylinder head 4 and the head cover 23 disposed at the rear side of the engine 3, i.e. at a portion near the upper end of the cam shaft 21.

The fuel pump 31 is arranged so that the movement direction L1 (FIG. 3) of the plunger 32 is shifted from and in parallel to the axis L2 of the cam shaft 21, and the front end of the plunger 32 projects downward, in FIG. 3, towards the upper end portion of the cam shaft 21.

According to the arrangement mentioned above, since projected members such as magneto device 24 and recoil starter 25 are not disposed to the rear upper surface of the engine 3, as to the front upper surface thereof, an adequate space can be ensured between the engine rear upper surface and the engine cover 9, so that there is no problem of arranging the fuel pump 31 to the rear upper surface of the engine 3.

Figure 5:
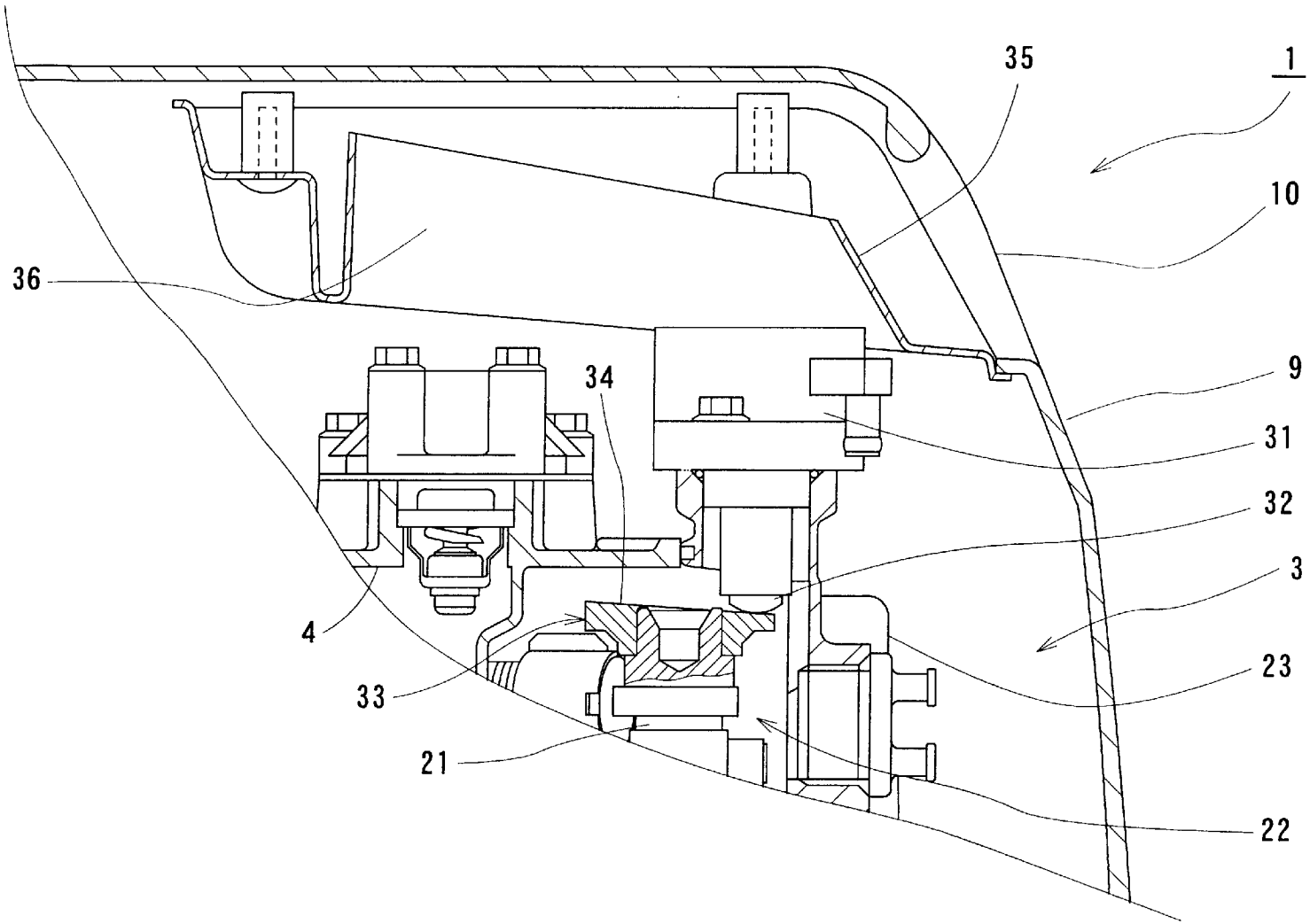
FIG. 5 shows an elevational section of a portion of a rear upper portion of the outboard motor in an enlarged scale according to another embodiment of the present invention.

Furthermore, according to one preferred example, as shown in FIG. 5, an arrangement, in which the opening 36 of the air intake port 35 formed to the rear upper portion of the engine cover 9 is positioned directly above the fuel pump 31, may be adopted, and in this arrangement, at least a portion of the fuel pump 31 will be accommodated in the air intake port 35 thereby to reduce the location height of the engine cover 9.

Figure 4A:
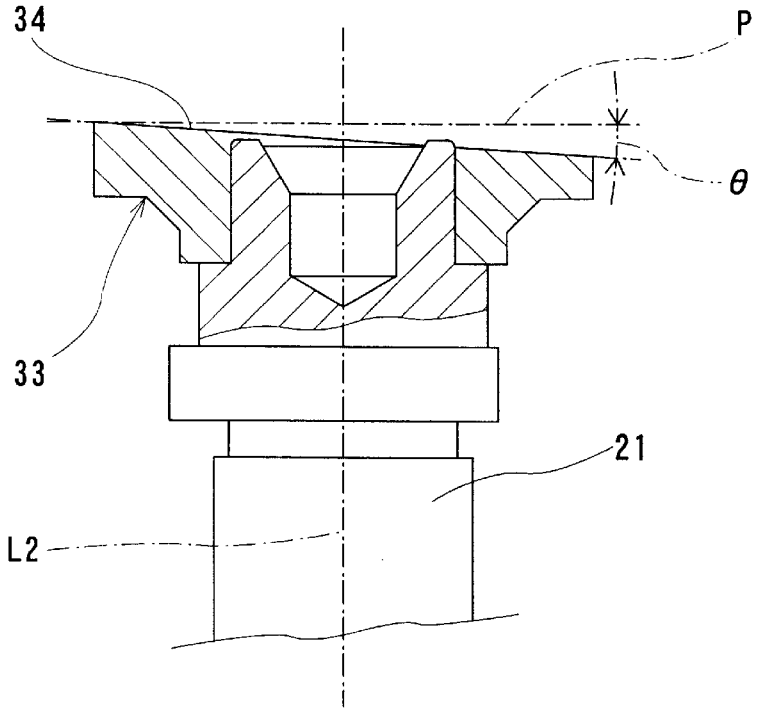
FIG. 4 includes FIGS. 4A and 4B showing sectional views, in an enlarged scale, of a swash plate cam.
Figure 4B:
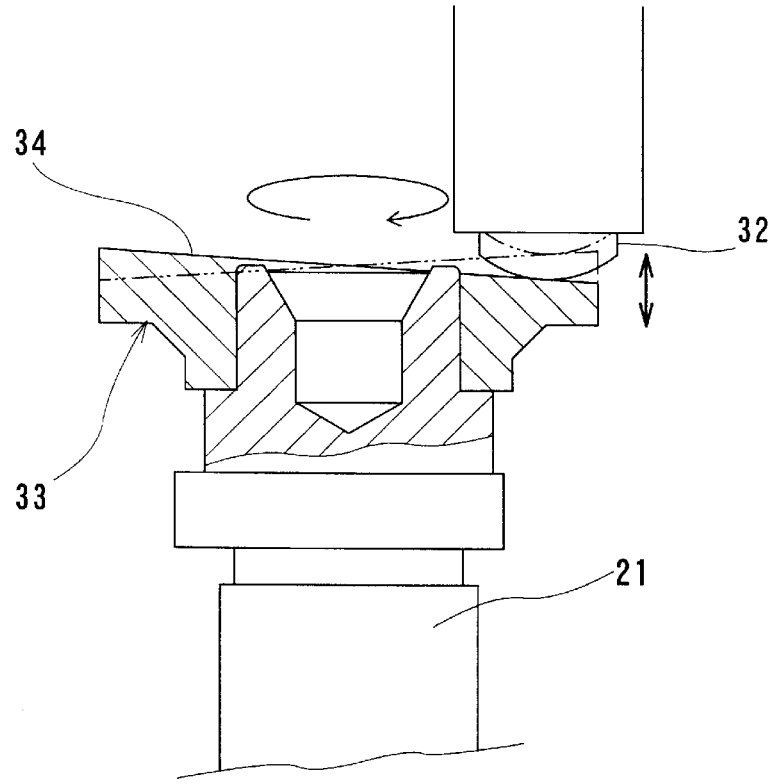

Still furthermore, as shown in FIG. 4A, a cam surface 34 is formed to the swash cam 33, such as swash plate cam, having a predetermined inclination angle θ with respect to a surface P perpendicular to the axis L2 of the cam shaft 21, the outer peripheral edge portion of the cam surface 34 is formed to be movable in the vertical direction as viewed in a side view by the rotation of the cam shaft 21. This inclination angle θ may be determined in accordance with the capacity of the pump or the like, and in one example, when the plunger takes perpendicular stroke of 3 mm, the angle is about 5°. Accordingly, the fuel pump 31 is arranged so that the reciprocal motion direction L1 of the plunger 32 of the fuel pump 31 is shifted to be parallel to the axis L2 of the cam shaft 21. According to such arrangement, the fuel pump 31 arranged on the rear upper surface of the engine 3 can be located and driven without taking any space in the longitudinal direction.

It is to be noted, as described above, that the present invention is not limited to the described embodiment and many other changes and modifications may be made without departing from the scopes of the appended claims.

What is claimed is:

1. An outboard motor of a structure in which a cam shaft is arranged substantially in parallel to a crank shaft disposed in an engine unit so as to perpendicularly extend in an operative state of an outboard motor and a fuel pump is disposed at a portion near an upper end portion of the cam shaft, wherein a swash cam means is disposed to an upper end of the cam shaft and said fuel pump is provided with a plunger having a projected end portion operatively contacting the swash cam means to be reciprocally movable in a direction substantially parallel to an axis of the cam shaft when the swash cam means is driven.

2. An outboard motor according to claim 1, wherein said swash cam means has a cam surface having an inclination with respect to a surface perpendicular to the axis of the cam shaft.

3. An outboard motor comprising:

an engine holder;

an engine unit disposed above the engine holder so as to be held by the engine holder in a usable state of an outboard motor, said engine unit including a cylinder head, a cylinder block and a crank case in which a crank shaft extends perpendicularly;

an engine cover covering the engine unit;

a fuel pump disposed to an upper portion of the engine unit and having a plunger extending downward to be reciprocally movable; and a valve moving mechanism disposed at a rear side portion of the engine unit and including a cam shaft disposed to be substantially parallel to the crank shaft, said cam shaft having an upper surface portion to which a swash cam means having an inclination with respect to the upper surface portion is formed so as to move the plunger perpendicularly when the swash cam means is driven.

4. An outboard motor according to claim 3, wherein said swash means is a swash plate cam.

5. An outboard motor according to claim 3, wherein said engine cover is formed with an air intake port and at least a portion of said fuel pump is accommodated in the air intake port.

* * * * *